US005090138A

United States Patent [19]

Borden

[11] Patent Number: 5,090,138

[45] Date of Patent: Feb. 25, 1992

[54] SPRING SHOE DEVICE

[76] Inventor: Robert Borden, 20 Cottage St., Wellesley, Mass. 02181

[21] Appl. No.: 535,669

[22] Filed: Jun. 11, 1990

[51] Int. Cl.[5] ..... A43B 7/32; A61H 1/00; A63B 21/00

[52] U.S. Cl. ..... 36/102; 36/89; 128/25 B; 272/70; 272/96; 272/101

[58] Field of Search ..... 36/88, 89, 90, 102; 128/80 R, 25 B; 272/70, 137, 139, 140, 101, 96

[56] References Cited

U.S. PATENT DOCUMENTS

| | | | |
|---|---|---|---|
| 420,179 | 1/1890 | Yagn | 272/70 |
| 979,243 | 12/1910 | Anderson | 272/70 |
| 1,236,714 | 8/1917 | Hoppe | 36/89 |
| 1,383,928 | 7/1921 | Gassette . | |
| 2,522,515 | 9/1950 | Hill | 36/43 |
| 2,952,459 | 9/1960 | Moffitt | 272/57 |
| 3,506,000 | 4/1970 | Baker | 128/166 |
| 3,775,872 | 12/1973 | Rathmell | 36/89 |
| 4,294,238 | 10/1981 | Woodford | 272/70 |
| 4,371,161 | 1/1983 | Williams | 128/80 R |
| 4,523,394 | 6/1985 | Lindh | 36/89 |
| 4,573,678 | 3/1986 | Lamb et al. | 128/25 R |
| 4,677,769 | 7/1987 | Ahmad et al. | 36/120 |
| 4,753,229 | 6/1988 | Sutherland | 36/89 |

FOREIGN PATENT DOCUMENTS

| | | | |
|---|---|---|---|
| 152823 | 8/1953 | Australia | 36/11.5 |
| 36701 | 3/1909 | Fed. Rep. of Germany | 272/70 |
| 322264 | 6/1920 | Fed. Rep. of Germany | 36/89 |
| 484633 | 10/1917 | France | 36/89 |
| 708497 | 7/1931 | France | 36/89 |

*Primary Examiner*—Paul T. Sewell
*Assistant Examiner*—Marie D. Patterson
*Attorney, Agent, or Firm*—Ware, Fressola, Van Der Sluys & Adolphson

[57] ABSTRACT

A spring shoe device for aiding the user in such activities as jogging or walking, comprising a heel socket for retaining the heel and sole of the user's foot pivotally mounted to a shin brace for bracing the user's shin within the spring shoe device and a spring strap connected therebetween for storing and releasing energy as a result of the user's activity. A toe pad, hingedly connected to the heel socket, provides support for the ball of the user's foot. The user's foot is inserted in the spring shoe device, the heel user's fitting into the heel socket and the lower portion of the user's shin being strapped into the shin brace. As the user does such activities as walking or jogging, the spring strap absorbs energy caused by the impact of the foot with the ground and releases that energy as the foot is extended at the end of each stride. The spring shoe may be worn in one of three ways: first, on the outside of the user's athletic shoe; second, as an insert to the user's athletic shoe; and finally, incorporated directly into the user's athletic shoe.

25 Claims, 3 Drawing Sheets

FIG. 2
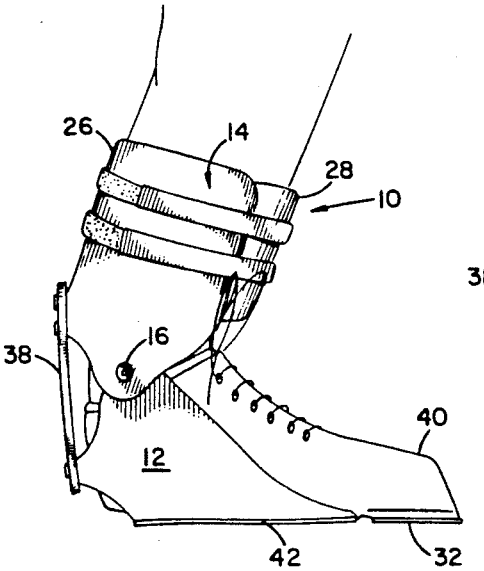
FIG. 4
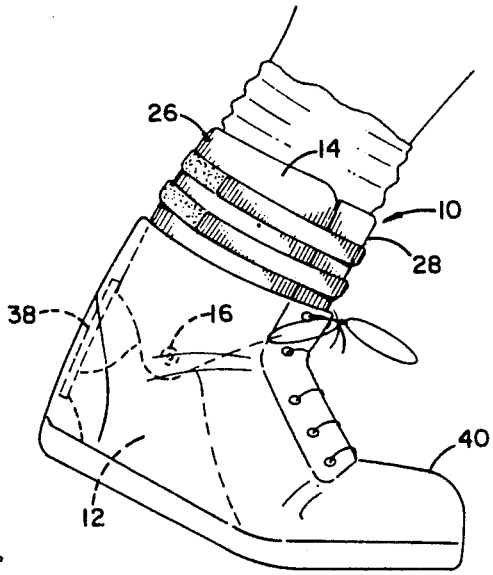
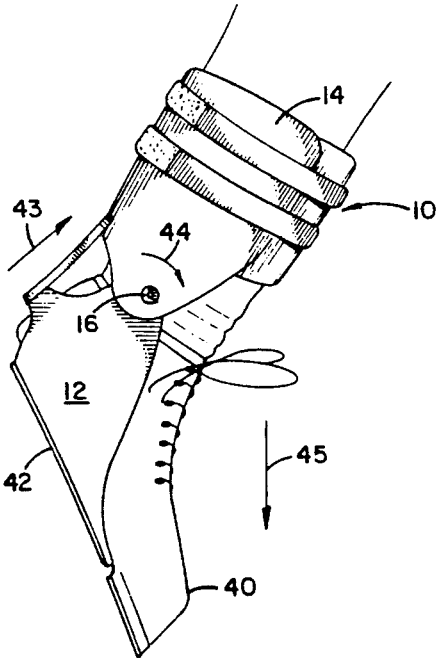
FIG. 3
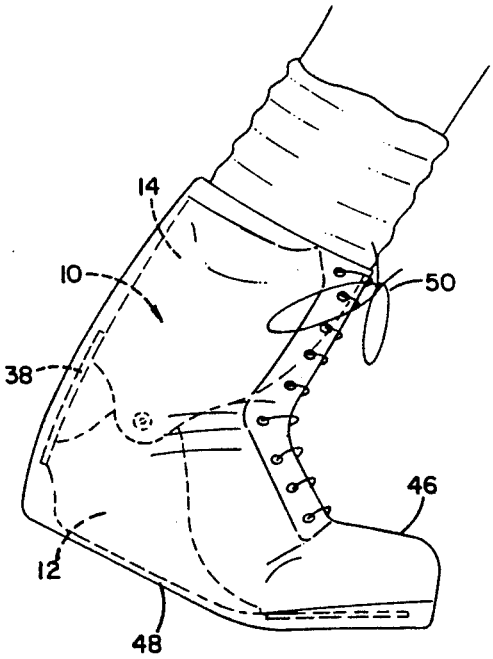
FIG. 5

FIG. 6
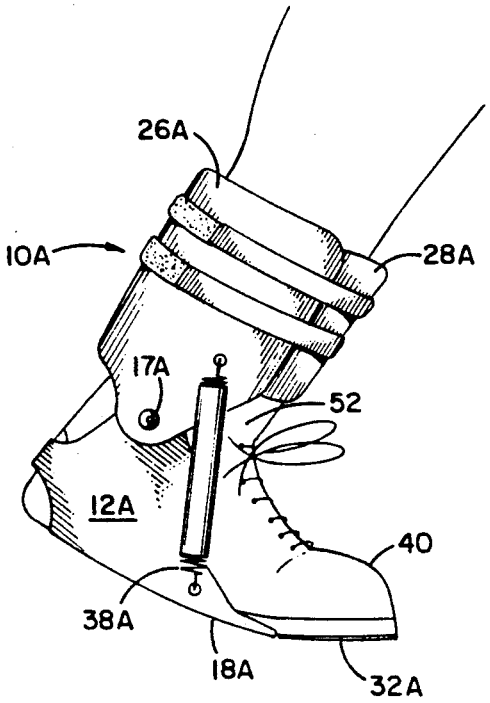
FIG. 8
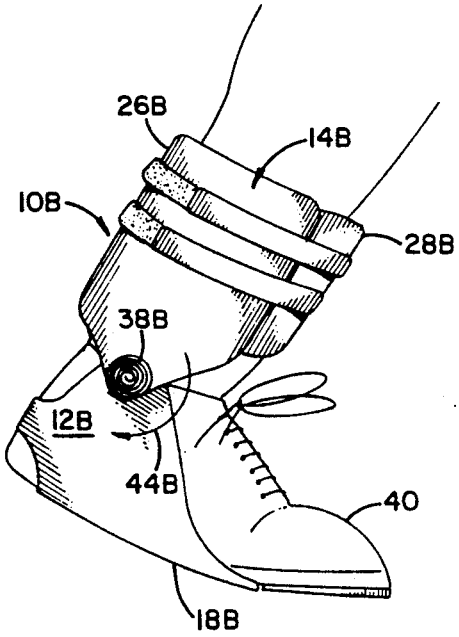
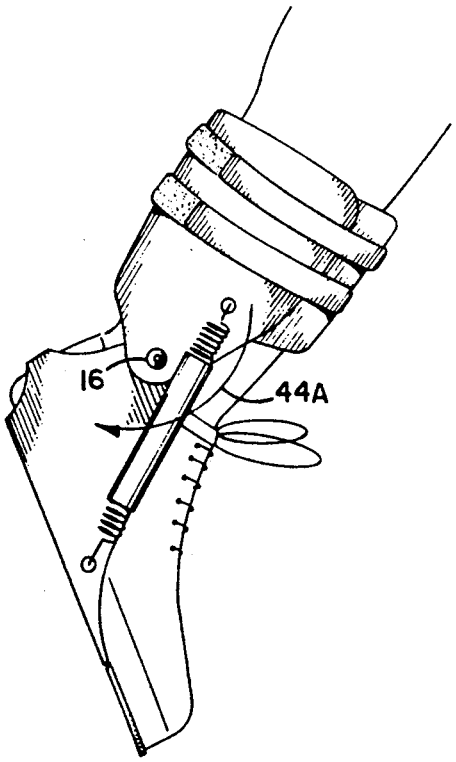
FIG. 7
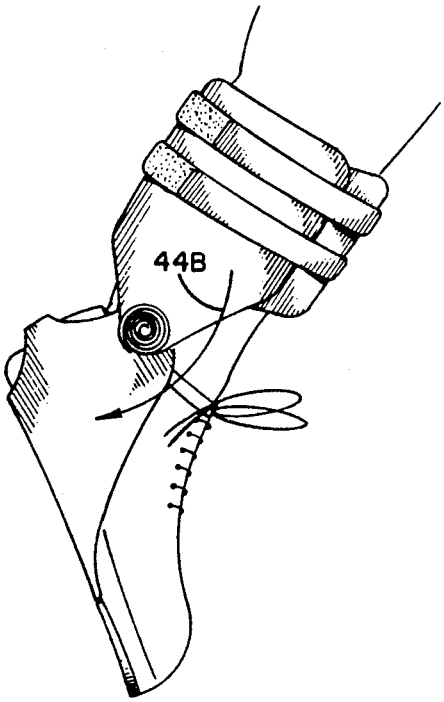
FIG. 9

SPRING SHOE DEVICE

BACKGROUND OF THE INVENTION

1. Field of the Invention

The present invention relates to athletic shoes for conserving the energy of a Walker, a jogger, a jumper or a cyclist, and more particularly to a spring shoe device having pivoted hinged components for providing a spring action for storing and releasing energy, urging the wearer upward and forward during every movement cycle.

2. Description of the Prior Art

Many devices have been developed in the past for facilitating physical activity and, more specifically, walking, jogging, and the like. The primary object of these devices is for aiding a user, such as a jogger, to more easily bend and extend the legs thereby decreasing fatigue and enhancing the user's performance. Another important object of such invention is to dampen the impact on the legs of a user caused by the physical activity, such as jogging.

In most of these prior art devices, one end of a spring is attached to the bottom part of the user's leg, many times the foot, and the other end is attached to another part of the user's body, i.e., the waist or the thigh, using various attachment means. Depending upon the design of each device, the spring could be of either the tension or the compression type, a tension spring having a tendency to retract when stretched and a compression spring having a tendency to expand when compressed.

In operation, the spring acts as a shock absorber for the body upon impact with the ground as the hips, knees, and ankles bend for movement of the body. The spring is either stretched or compressed (depending upon its type) out of its original shape thereby absorbing some of the impact. As the back leg is extended to drive the body forward, as in a jogger's stride, the spring exerts a force, as it tends to return to its original shape, in parallel with the user's muscles, thereby aiding the user in the physical activity.

However, many problems are inherent in these energy-saving devices. For instance, those devices attaching to the user above the knee comprised springs or spring bars, are disposed away from the user's body, especially during the bending of the legs. Yagn, U.S. Pat. No. 420,179, shows an apparatus for facilitating walking, running, and jumping. The apparatus comprises a plurality of spring bars attached, at one end, to the user's feet by straps and, at the other end, to the waist and back of the user. As the user moves, for instance, in a jogger's motion, the bars alternatively bend and straighten in accordance with the user's stride thus facilitating the movement. The bars, however, bend away from the body thereby making the apparatus bulky and unable to be utilized beneath the user's clothing.

Anderson, U.S. Pat. No. 979,243, discloses a similar apparatus for facilitating walking comprising a plurality of spring bars attached at one end to the user's foot and to the user's thigh at the other end. As in Yagn, the spring bars bend and straighten in accordance with the user's movement, as in walking. Anderson has the similar problem as Yagn in that the bars bend away from the user's body thereby making it bulky and inconvenient to use. In addition, the Anderson apparatus shows the spring bar being strapped to the body above the user's knee, thereby making the apparatus uncomfortable and unattractive, especially if the user desires to wear short pants, short pants being normal attire for such physical activities.

Woodford, U.S. Pat. No. 4,294,338, discloses a lower limb aid device comprising an elastic strap behind the calf which is attached at one end to the "waist" of the user's foot and at the other end above the user's knee. The elastic strap is attached to the bottom of the user's foot using the well-known Velcro® brand hook-and-loop area fastener straps, wrapped forward of the user's heel, and attached above the user's knee again using Velcro® straps. In another embodiment, the elastic strap is comprised of two individual elastic straps which are attachable and length adjustable using Velcro® brand straps. The elasticity of the elastic strap provides an aid to the user's calf muscle in such activities as walking or jogging.

The Woodford device, however, does not provide absorptive propulsive forces in parallel with the natural movement of the user's foot, that is, in parallel with the pivoting motion of the user's foot about the ankle. In contrast, Woodford's elastic strap stretches and retracts in accordance with the movement of the foot, using the heel as a fulcrum. Therefore, the device described in Woodford does not aid the user's foot in pivoting at the ankle, but rather acts to pull the waist of the foot towards the heel of the user.

Furthermore, the Woodford device has problems in that it is inconvenient to use because the elastic strap must be attached to the user's foot and to the user's knee before putting on socks, shoes, pants, etc. In addition, it is unattractive to those users who want to wear short pants because the device is completely exposed from the user's ankle to the user's knee.

SUMMARY OF THE INVENTION

The present invention in one form incorporates a spring shoe device comprising a heel socket which is dimensioned and shaped to fit the user's heel and a portion of the bottom of the user's, foot and a shin brace for anchoring the lower portion of the user's shin to the spring shoe device. The heel socket and the shin brace are connected together in a hinge-like manner and are therefore pivotable about one and other on a single axis, the axis being in alignment with the user's ankle. In one embodiment, an elastic strap is attached to the back portion of both the heel socket and the shin brace, thereby urging them toward each other and providing an elastic retractive force upon the heel socket about the ankle axis. In addition, if desired, a toe pad is connected by a hinge to the front part of the heel socket for cooperating with the user's toes during operation.

The heel socket, shin brace and toe pad are formed of a thin plastic or polymeric material thereby making the spring shoe device durable and lightweight. The heel socket is molded in the shape of the user's heel and, similarly, the shin brace is molded for cooperation with the shin, thus making the spring shoe device comfortable to wear.

These components are preferably incorporated within the walls of a sports shoe, between the lining and the outer covering, as hereafter described.

The spring shoe device is compact in size, the heel socket and toe pad fitting snugly along the bottom of the user's foot and the shin brace gripping the lower portion of the user's shin, just above the ankle. In addition, the spring shoe device preferably utilizes an elastomeric strap which is disposed behind the user's calf, closely paralleling the user's Achilles tendon. Thus, the spring shoe device offers the user an energy absorbing and releasing device which is not bulky and is convenient to use.

Because of the spring shoe device's compact size, the spring shoe device may be utilized in one of three ways. First, the spring shoe device may be worn on the outside of the user's normal sport shoe. In this embodiment, the spring shoe heel socket has a layer of rubber or elastomeric material along its bottom or, in the alternative, may be entirely comprised of rubber material. Similarly, the toe pad is lined or entirely comprised of rubber. The rubber lining provides the shoe with a cushion when impacting the ground and traction when contacting concrete or the like. In this first embodiment, the user simply puts on his standard athletic shoe and inserts the heel of the athletic shoe into the back of the heel socket and straps his shin into the shin brace.

In a second embodiment, a more compact version of the spring shoe device may be inserted directly into the user's athletic shoe. In this embodiment, the user inserts his heel into the back of the heel socket and straps his shin into the shin brace. The user then inserts his foot, with the spring shoe device on, into the athletic shoe.

In a third and preferred embodiment, the spring shoe device is actually incorporated directly into the user's athletic shoe. This would, naturally, be accomplished by the manufacturer of the athletic shoe. To utilize the spring shoe in this embodiment, the user simply puts on the athletic shoe as he would with any standard athletic shoe. This athletic shoe may extend slightly higher on the shin than, for instance, a high top basketball shoe.

The spring shoe device of the present invention operates in the following manner. The heel socket and the shin brace are partially pivotally rotatable about a single axis, the user's ankle axis. As the user walks or jogs, the elastic strap stretches and retracts in accordance with the pivoting movement of the user's foot about the user's ankle. Thus, the elastic strap acts as a shock absorber as the user's extended foot impacts the ground, and as a launching spring as the user pivots his retracted foot downward to leave the ground in a toe-extended position at the end of a stride. The shin brace acts as a comfortable support to transmit this torque to and from the user's leg.

Accordingly, the principal object of the invention is to provide a comfortable spring shoe device for storing and releasing energy of an athlete.

A further object of the invention is to provide a spring shoe device which in one aspect may be inserted into a user's athletic shoe and is strapped to the user's shin during operation.

A further object of the present invention is to provide a spring shoe device which in another aspect may be utilized on the outside of a user's athletic shoe, the user simply slipping the heel of his athletic shoe into a heel socket and strapping his shin into a shin brace.

Another object of the invention is to provide a spring shoe device which may preferably be incorporated directly into an athletic shoe for facilitating such activities as walking, jogging, cycling and jumping.

Still another object of the invention is to provide a spring shoe device incorporating either tension, compression or torsion spring means for storing and releasing the user's energy.

Other objects of the invention will in part be obvious and will in part appear hereinafter.

The invention accordingly comprises the features of construction, combinations of elements, and arrangements of parts which will be exemplified in the constructions hereinafter set forth and the scope of the invention will be indicated in the claims.

For a foreunderstanding of nature and objects of the invention, reference should be had to the following detailed description taken in conjunction with the accompanying drawings, in which:

DESCRIPTION OF THE DRAWINGS

FIG. 2 is a perspective view of a first embodiment of the spring shoe device of the present invention shown strapped to the user's foot as in operation, the user's foot being in a retracted position, just before launching the next stride;

FIG. 3 is a corresponding perspective view of the first embodiment of same spring shoe device shown in operation, the user's foot being fully extended as at the end of the user's stride;

FIG. 4 is a perspective view of a second embodiment of the spring shoe device of the present invention, shown as worn by a user inserted in an athletic shoe;

FIG. 5 is a perspective view of a third embodiment of the spring shoe device of the present invention, shown as worn by a user, the spring shoe device being incorporated in an athletic shoe;

FIGS. 6 and 7 are corresponding perspective views of a fourth embodiment of the spring shoe device of the present invention shown as worn by a user, FIG. 6 showing a partially retracted position and FIG. 7 showing an extended position; and FIGS. 8 and 9 are corresponding perspective views of fifth embodiment of the spring shoe device of the present invention'shown as worn by a user, FIG. 8 showing a retracted position and FIG. 9 showing an extended position.

DESCRIPTION OF THE PREFERRED EMBODIMENT

Figure 1:
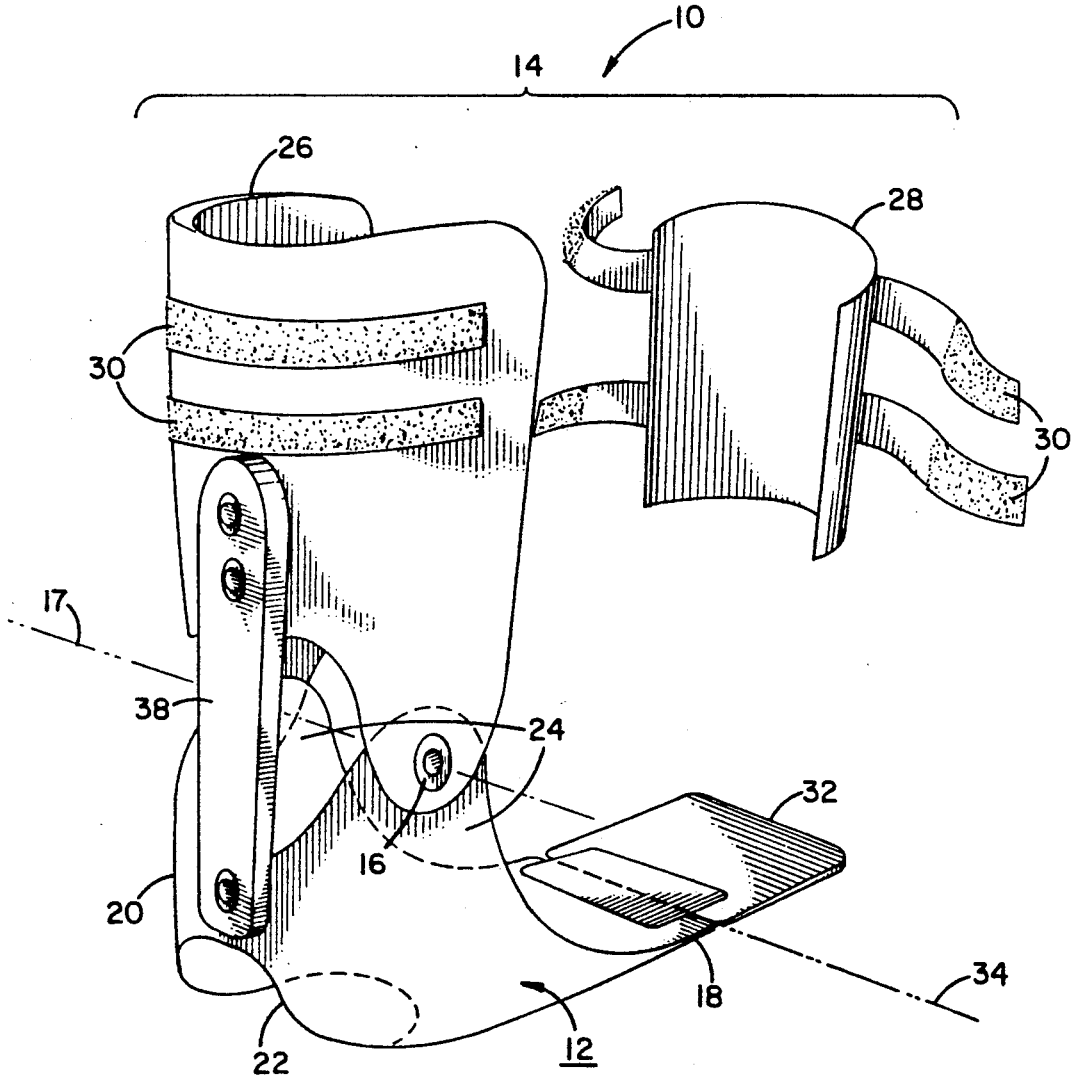
FIG. 1 is a perspective view of a spring shoe device of the present invention, shown in a partially retracted condition, as for a standing user.

As can be seen most clearly in FIG. 1, a spring shoe device 10 of the present invention comprises a heel socket 12 and a shin brace 14. Heel socket 12 is pivotally connected to shin brace 14 at ankle hinge 16. Heel socket 12, which is preferably formed of a plastic or polymeric material, is dimensioned and molded so that the base of the user's foot will sit comfortably within the socket 12. Heel socket 12, which has a toe end 18 and a heel end 20, each dimensioned and molded to comfortably match the sole and back of the user's foot respectively, further comprises a heel pocket 22 to receive the user's heel When the spring shoe device 10 is being worn. On each of its two sides, heel socket 12 has a hinge ear 24 where heel socket 12 is pivotally connected to shin brace 14, the heel socket 12 thus being pivotable about ankle hinge axis 17.

Shin brace 14, which is also preferably formed of plastic or polymeric material, comprises a calf member 26 which is dimensioned and molded to comfortably fit the rear lower portion of the user's calf and a shin member 28 which is dimensioned and molded to comfortably fit the front lower portion of the user's shin, just above the ankle. Shin member 28 is adjustably secured to calf member 26 using securing straps 30 and holding straps 31 which are preferably formed of a releasable self-holding hook-and-loop area fastener fabric such as the conventional Velcro® brand releasable self-holding fabric. A portion of the securing straps, which are comprised of the "hook" portion of the fastener fabric, is attached to the shin member by adhesive or the like. The holding straps, which are comprised of the "loop" portion of the fastener fabric, are entirely adhered to the calf member by an adhesive. Shin member 28 may be adjustably secured to calf member 26 so that shin brace 14 comfortably fits and anchors the lower portion of the user's leg to the spring shoe device 10.

Spring shoe device 10 further comprises toe pad 32 which is hingedly connected to toe end 18 of heel socket 12 by toe hinge 34. Toe pad 32, Which is preferably comprised of a light plastic or polymeric material, provides support for the front portion of the user's foot during use. Toe pad 32 is molded to comfortably fit under the front portion of the user's foot, approximately from the ball of the foot to the end of the toes.

Toe hinge 34, which lies in proximity to the ball of the user's foot, allows toe pad 32 to partially rotate about the axis of the toe hinge 34. Thus, toe pad 32 may pivot in relation to heel socket 12 in association with the front portion of the user's foot during physical activity such as walking or jogging.

Spring shoe device 10 further comprises a spring strap 38 which is attached between its lower heel end 20 and the back of calf member 26. Spring strap 38 is comprised of a stretchable elastomeric material such as a highly resilient rubber but, alternatively, may be comprised of a tension spring, the tension spring having a tendency to exert a retractive force when stretched. As the user's foot is inserted into the spring shoe device, the spring strap 38 parallels the Achilles tendon of the user's foot. Spring strap 38, having elastomeric characteristics, provides a retractive force drawing its heel end 20 at heel socket 12 toward the back of calf member 26, thus forcing a partial rotation of heel socket 12 about ankle hinge axis 17 with relation to shin brace 14, from the retracted position of FIG. 2 toward the extended position of FIG. 3. Spring strap 38 is chosen so that heel socket 12 may pivot about ankle hinge axis 17 through the full range of motion of the user's foot with respect to the user's shin.

For use, the user's foot is inserted into the heel socket with the user's heel being disposed in heel pocket 22 and user's toes being juxtaposed with toe pad 32. The lower portion of the user's calf, just above the ankle, is disposed against the inside of calf member 26. The front part of the same portion of the user's calf, just above the ankle, is disposed against the inside portion of shin member 28 as shin member 28 is tightly but comfortably secured to calf member 26 by securing straps 30, thus anchoring the user's shin within the spring shoe device 10. Because of spring strap 38, heel socket 12 has a tendency to rotate about ankle hinge axis 17 in a direction similar to the extension of the user's foot. Because of this rotational tendency caused by the spring strap 38, spring shoe device 10 functions to aid the user in extending the foot to drive the body upward and forward during such activities as jogging or jumping and, in addition, to act as a shock absorber for the legs and the body as the foot impacts the ground.

Spring shoe device 10 essentially acts as an apparatus which alternatively stores and releases energy. Energy resulting from the impact of the user's foot with the ground, which is normally dissipated throughout the user's body via the user's joints, bones and muscles, is conserved by the stretching of the spring strap 38. Thus, the user's body, especially the joints and bones, are partially relieved of the shock absorber function when the user is engaged in such pounding activities as jogging or jumping. A user whose body is partially relieved of the stresses of such pounding activities over a period of years by utilizing the spring shoe device 10 of the present invention, may be relieved of such nagging joint and bone injuries as bone spurs and arthritis. Thus, spring shoe device 10 not only acts to aid the user in such activities as walking and jogging, but it also helps the user remain physically healthy by protecting the user's bones and joints.

The energy which has been stored in the stretched spring strap 38 is released to the heel socket 12 upon the extension of the user's foot, such as at the end of a stride or jump. Spring shoe device 10 acts in parallel with the user's leg muscles, and more specifically calf muscles, to force the extension of the user's foot away from the user's shin.

In addition, because heel socket 12 is pivotable solely about ankle hinge axis 17, the user's foot is restricted from any movement other than about this axis. Thus, spring shoe device 10 provides ankle support and thereby aids in the prevention of such ankle injuries as stretched or damaged ligaments resulting from the inadvertent twisting of the ankle, by restricting the foot's movement about the ankle hinge axis 17. Such ankle support is highly desirable in such sports as basketball where ankle injuries are common.

Spring shoe device 10 may be utilized by the user in one of three embodiments. The first embodiment as shown in FIGS. 2 and 3 comprises spring shoe device 10 being worn on the outside of the user's athletic shoe 40. The athletic shoe worn by the user may be of any type which may be purchased at a local sporting goods or shoe store. Heel socket 12 and toe pad 32 are dimensioned to fit snugly around the outside of the athletic shoe and are provided with a rubber, or polymeric material lining 42 along the bottom therewith so as provide traction and cushioning for the user during physical activity. The shin brace 14 which securely braces the shin and calf in the spring shoe device 10 is provided with a padded inner lining (not shown) for user comfort.

FIG. 2 illustrates the user's foot and leg just subsequent to impact with the ground, and spring shoe device 10 is in its retracted position with the spring strap 38 being stretched from its original shape. Much of the force of the impact is absorbed by the stretching of the strap 38 rather than being absorbed by the user's bones and joints. As the user completes his stride and launches himself again, as shown in FIG. 3, the spring strap 38 releases the stored energy by exerting a retractive force as shown by arrow 43 which causes the clockwise rotation 44 of heel socket 12 about ankle hinge axis 17 thereby aiding the user's leg in driving the body in an upward and forward direction as shown by arrow 45.

In a second embodiment, the spring shoe device 10 may be inserted inside of the athletic shoe 40 as shown in FIG. 4. In this embodiment, heel socket 12 and toe pad (not shown) are molded to fit the user's foot rather than an athletic shoe. In addition, heel socket 12 and toe pad, similar to shin brace 14, are provided with a padded inner lining (not shown) for user comfort and, in contrast to the first embodiment, do not have a rubber sole for traction.

In a third embodiment, spring shoe device 10 may be directly incorporated into an athletic spring shoe 46 as shown in FIG. 5. The third embodiment provides the user with the best overall performance because the athletic spring shoe 46 is adapted by the manufacturer to fit the spring shoe device 10.

The athletic spring shoe 46 which rises above the ankle of the user slightly higher than a standard high-top basketball shoe, provides a rubber sole 48 for traction and inner padding (not shown) for comfort to the user. Additionally, athletic spring shoe 46 provides lacing 50 to the top of shin brace 14, thereby providing a securing means for bracing the shoe 46 to the lower portion of the user's leg. Because this spring shoe device 10 is incorporated within the athletic spring shoe 46, the user simply slips his foot within the shoe 46 and laces it up. This is the most convenient and attractive and, therefore, most preferred embodiment.

FIG. 6 shows a spring shoe device 10A having a compression spring 38A attached between a calf member 26A and the forward part of heel socket 12A, ahead of ankle pivot hinge axis 17A. Compression spring 38A, having a tendency to expand when compressed is encompassed by guide tube 52 which prevents compression spring 38A from buckling when compressed. Thus, spring shoe device 10A acts as a shock absorber upon impact to the ground (FIG. 6) and releases the energy as shown by arrow 4A absorbed thus aiding in the extension of the user's foot (FIG. 7) such as at the end of a stride or jump.

FIGS. 8 and 9 show a spring shoe device 10B having torsion spring configuration. Spring shoe device 10B has a torsion spring 38B attached between shin brace 14B and heel socket 12B. Torsion spring 38B has a tendency to exert a clockwise twisting or rotational force 44B as shown in FIG. 8.

As the user's foot impacts the ground, torsion spring 38B twists in a counter clockwise direction, absorbing and storing the impacting energy. As the user finishes his stride, as shown in FIG. 9, torsion spring 38B releases its stored energy by forcing the heel socket 12B into clockwise pivotal rotation 44B thereby aiding the user's leg muscles in completing the stride or jump. It should be noted that each of the two alternative spring configurations (10A, 10B) may be incorporated into any of the three above described embodiments, i.e., disposed on the outside of a standard athletic shoe (first embodiment), disposed on the inside of a standard athletic shoe (second embodiment) or incorporated into a specially manufactured athletic spring shoe (third embodiment).

Thus, it can be seen that such a spring shoe device may be utilized in any physical activities where there is great pounding upon the feet (jogging, walking), where there is a need for jumping high (basketball, volleyball) and where there is a need for ankle support and spring action (hiking, basketball). In addition, it can be seen that such a spring shoe device can be conveniently utilized and is compact and thereby may, consequently, incorporate or work entirely within an athletic shoe. Since it does not extend above the knee, the spring shoe device of the present invention may be worn with short pants, the typical attire of the the participants of the above mentioned activities.

It will thus be seen that the objects set forth above, among those made apparent from the proceeding description, are efficiently obtained and, since certain changes may be made in the above constructions without the departing from the scope of the invention, it is intended that all matter contained in the above description or shown in the accompanying drawings shall be interpreted as demonstrative and not in any limiting sense.

It is also to be understood that the following claims are intended to cover all of the generic and specific features of the invention herein described, and all statements of the scope of the invention which, as a matter of language, might be said to fall therebetween.

What is claimed is:

1. An athletic shoe for aiding the extension of a user's foot such as at the end of a stride and for retarding the retraction of the user's foot such as upon ground impact, said shoe having an inner lining-insole portion for receiving said foot and a lower portion of the leg, said shoe comprising:

a) a flexible outer covering member;

b) a flexible sole attached to said outer covering member; and c) a spring device disposed between said inner portion and said outer covering member, said spring device being operatively connected both to said sole and to said inner portion adjacent to the lower portion of the user's leg, said device comprising:

(i) a shin socket member having a hinge defining a hinge axis, said shin socket member being dimensioned to be disposed against said lower leg portion;

(ii) means for anchoring said shin socket member to said lower leg portion;

(iii) a heel socket member dimensioned to be disposed about the heel of the foot and pivotally connected to said hinge and being pivotable about said hinge axis in a first extension direction wherein said heel socket member is rotated relative to said shin socket member in the user's foot extension direction and in a second retraction direction wherein said heel socket member is rotated relative to said shin socket member in the user's foot retraction direction; and (iv) resilient means attached between said shin socket member and said heel socket member for pivotably urging the heel socket member in said first extension direction.

2. The athletic shoe defined in claim 1, wherein said resilient means comprises a spring strap formed of elastomeric material, said spring strap being attached between said shin socket member and said heel end of said heel socket member.

3. The athletic shoe defined in claim 2, wherein said athletic shoe further comprises a toe pad dimensioned to be disposed against the ball and toes of the foot of the user, said toe pad hingedly connected to said toe end of said heel socket member.

4. The athletic shoe defined in claim 3, wherein said shin socket member comprises a first shin of member dimensioned to be disposed against the lower portion of the shin of the user, and a second calf member dimensioned to be disposed against the lower portion of the calf of the user, said first shin member being attachable to said second calf member by said anchoring means.

5. The athletic shoe defined in claim 4, wherein said anchoring means comprises securing straps for adjustably anchoring the lower portion of the leg of the user between said first shin member and said second calf member.

6. The athletic shoe defined in claim 5, wherein said heel socket member is formed of moldable plastic material.

7. The athletic shoe defined in claim 6, wherein said shin socket member is formed of moldable plastic material.

8. The athletic shoe defined in claim 7, wherein said toe pad is formed of moldable plastic material.

9. The athletic shoe defined in claim 1, wherein said resilient means comprises a tension spring having a tendency to retract when extended, said tension spring being attached between said shin socket member and said heel end of said heel socket member.

10. The athletic shoe defined in claim 1, wherein said resilient means comprises a compression spring having a tendency to expand when compressed, said compression spring being attached between said shin socket member and said toe end of said heel socket member.

11. The athletic shoe defined in claim 1, wherein said resilient means comprises a torsion spring having a tendency to exert torque about a longitudinal axis, said torsion spring being attached between said shin socket member and said heel socket member and said longitudinal axis being said ankle hinge axis.

12. The athletic shoe defined in claim 1, wherein said resilient means comprises a spring strap comprised of elastomeric material, said spring strap being attached between said shin socket member and said heel end of said heel socket member.

13. The athletic shoe defined in claim 12, wherein said athletic shoe further comprises a toe pad dimensioned to be disposed against the ball and toes of the foot of the user, said toe pad being hingedly connected to said toe end of said heel socket member.

14. The athletic shoe defined in claim 13, wherein said shin socket member comprises a first shin member dimensioned to be disposed against the lower portion of the shin of the user and a second calf member dimensioned to be disposed against the lower portion of the calf of the user, said first shin member being attachable to said second calf member by said anchoring means.

15. The athletic shoe defined in claim 12, wherein said heel socket member is formed of moldable plastic material.

16. The athletic shoe defined in claim 13, wherein said shin socket member is formed of moldable plastic material.

17. The athletic shoe defined in claim 1, wherein said anchoring means comprises securing straps for adjustably anchoring the lower portion of the leg of the user between said first shin member and said second calf member.

18. The athletic shoe defined in claim 17, wherein said anchoring means comprises laces for adjustably anchoring the lower portion of the leg of the user between said first shin member and said second calf member.

19. The athletic shoe defined in claim 18, wherein said toe pad is formed of moldable plastic material.

20. The athletic shoe defined in claim 1, wherein said resilient means comprises a tension spring having a tendency to retract when extended, said tension spring being attached between said shin socket member and said heel end of said heel socket member.

21. The athletic shoe defined in claim 1, wherein said resilient means comprises a compression spring having a tendency to expand when compressed, said compression spring being attached between said shin socket member and said toe end of said heel socket member.

22. The athletic shoe defined in claim 1, wherein said resilient means comprises a torsion spring having a tendency to exert torque about a longitudinal axis, said torsion spring being attached between said shin socket member and said heel socket member and said longitudinal axis being said ankle hinge axis.

23. The athletic shoe defined in claim 1, wherein said flexible upper cover member is comprised of leather.

24. The athletic shoe defined in claim 1, wherein said flexible sole is comprised of rubber.

25. The spring shoe device to be worn by a user for aiding the extension of the user's foot such as the end of a stride and for retarding the retraction of the foot such as upon ground impact, the spring shoe device comprising:

a) a shin socket member having a hinge defining a hinge axis, said shin socket member being dimensioned to be disposed against the lower portion of the leg of the user;

b) a heel socket member having a heel end and a toe end, said heel socket member being dimensioned to be disposed bout the heel of the user and being connected to said hinge and being pivotable above said hinge axis in a first extension direction wherein said heel socket member is rotated relative to said shin socket member in said foot extension direction and in a second retraction direction wherein said heel socket member is rotated relative to said shin socket member in said foot retraction direction;

c) resilient means attached between said shin socket member and said heel socket member for pivotally urging the heel socket member in said first extension direction, said resilient means comprising a torsion spring having a tendency to exert torque about a longitudinal axis, said torsion spring being attached between said shin socket member and said heel socket member and said longitudinal axis being said hinge axis; and d) means for anchoring said shin socket member to the lower portion of the leg of the user.

* * * * *